US012139857B2

(12) United States Patent
Shue et al.

(10) Patent No.: US 12,139,857 B2
(45) Date of Patent: Nov. 12, 2024

(54) CURVED INSULATED RAIL JOINT BAR AND METHODS FOR MAKING SAME

(71) Applicant: L. B. FOSTER COMPANY, Pittsburgh, PA (US)

(72) Inventors: Sidney Shue, Canonsburg, PA (US); Faizan Ansari, Pittsburgh, PA (US)

(73) Assignee: L.B. Foster Company, Pittsburgh, PA (US)

( * ) Notice: Subject to any disclaimer, the term of this patent is extended or adjusted under 35 U.S.C. 154(b) by 729 days.

(21) Appl. No.: 17/133,124

(22) Filed: Dec. 23, 2020

(65) Prior Publication Data

US 2022/0195673 A1 Jun. 23, 2022

(51) Int. Cl.
*E01B 11/08* (2006.01)

(52) U.S. Cl.
CPC ..... *E01B 11/08* (2013.01)

(58) Field of Classification Search
CPC ..... E01B 11/00; E01B 11/02; E01B 11/04; E01B 11/08; E01B 11/16; E01B 11/18; E01B 11/36
See application file for complete search history.

(56) References Cited

U.S. PATENT DOCUMENTS

2019/0127923 A1* 5/2019 Singleton ..... E01B 11/54

* cited by examiner

*Primary Examiner* — Robert J McCarry, Jr.
(74) *Attorney, Agent, or Firm* — Paul D. Bangor, Jr., Esq.; Clark Hill PLC

(57) ABSTRACT

A rail joint bar, comprising: a first side and a second side; wherein the first side has a longitudinal axis and a first outer surface curved convexly or concavely along the longitudinal axis and wherein the first outer surface defines a rounded shape conforming to and fitting within a concavely or convexly curved channel of a side of a curved railroad rail joint, wherein the concavely or convexly curved channel is defined by a web, a head and a foot of the railroad rail joint; and wherein the second side has a second outer surface that has a flat surface following the same curvature of the first side.

20 Claims, 5 Drawing Sheets

CURVED INSULATED RAIL JOINT BAR AND METHODS FOR MAKING SAME

FIELD OF THE DISCLOSURE

The present disclosure is related to the field of insulated rail joint bars for making insulated railroad rail joints, and more specifically, to curved insulated rail joint bars for making curved insulated railroad rail joints and methods for making the same.

BACKGROUND

Insulated rail joints are used in signal control and broken rail detection in signaled railroads. They are supplied to the railroads in assembled condition or in kit form, which can be assembled on the rail in the field. Joint bars are normally made out of straight rolled steel sections. Presented invention is about a method of producing a curved bar design that can be applied on curved rails in the field.

Insulated rail joints are common and critical elements of signaled railroad infrastructure. They structurally connect electrically separated sections of railroad track. There are various designs for insulated rail joints. All widely known insulated rail joint designs involve electrically insulating joint bars that connect two rails together. Having an insulated element such as a fiberglass cloth adhesively bonded on bars, making the bars electrically insulating, is a common method of producing an insulated joint bar. Such bars are assembled on rails in a plant or in the field using the same adhesive to complete the joint assembly. There are other methods such as encapsulating bars in hard plastic compounds or making the bars out of non-metallic structural composites.

Standard practice is to use straight bars and rails for building insulated rail joints. Bars may be very slightly bend without disturbing the adhesive bond between the bar and the insulation occasionally.

Producing a standard insulating joint bar involves cutting, drilling of the bar, and assembling the same bar with an insulating cloth by adhesively bonding them together. Producing a curved insulated rail joint bar by simple bending of a straight insulated rail joint bar is not technically feasible, because the adhesive bond would break, and the product would not serve its purpose.

One method to produce curved bars could be to add a bending step prior to molding, but this would generate residual stresses around the holes in the product and having such residual stresses are detrimental to long term product performance.

The present disclosure outlines how a curved insulated joint may be produced for tight curves. An 82' (25 m) track radius of curvature has been chosen as a preferred curvature for this curved insulated joint bar design, but the same method can be used to produce bars to meet any required radius.

BRIEF SUMMARY OF THE DISCLOSURE

Many other variations are possible with the present disclosure, and those and other teachings, variations, and advantages of the present disclosure will become apparent from the description and figures of the disclosure.

One aspect of a preferred embodiment of the present disclosure comprises a rail joint bar, comprising: a first side and a second side; wherein the first side has a longitudinal axis and a first outer surface curved convexly along the longitudinal axis and wherein the first outer surface defines a rounded shape conforming to and fitting within a concavely curved channel of a side of a curved railroad rail joint, wherein the concavely curved channel is defined by a web, a head and a foot of the railroad rail joint; and wherein the second side has a second outer surface that has a flat surface following the same curvature of the first side.

In another aspect of a preferred rail joint bar of the present disclosure, the first outer surface has a radius of curvature of 82' (25 m) feet.

In yet another aspect of a preferred rail joint bar of the present disclosure, the first outer surface has a radius of curvature of 75 to 85 feet In a further aspect of a preferred rail joint bar of the present disclosure, the rail joint bar defines a plurality of bolt holes.

In another aspect of a preferred rail joint bar of the present disclosure, the rail joint bar defines six or eight bolt holes disposed along a longitudinal center line of the rail joint bar.

In yet another aspect of a preferred rail joint bar of the present disclosure, the two or three outermost bolt holes on each side of the longitudinal center line of the rail joint bar were produced prior to, and the two innermost bolt holes thereon were produced after, the bending of the rail joint bar to produce the convexly curved first outer surface.

Another aspect of a preferred embodiment of the present disclosure comprises a rail joint bar, comprising: a first side and a second side; wherein the first side has a longitudinal axis and a first outer surface curved concavely along the longitudinal axis and wherein the first outer surface defines a shape conforming to and fitting within a convexly curved channel of a side of a curved railroad rail joint, wherein the convexly curved channel is defined by a web, a head and a foot of the railroad rail joint; wherein the second side has a second outer surface that has a flat surface following the same curvature of the first side.

In another aspect of a preferred rail joint bar of the present disclosure, the first outer surface has a radius of curvature of 82' (25 m) feet.

In a further aspect of a preferred rail joint bar of the present disclosure, the first outer surface has a radius of curvature of 75 to 85 feet.

In another aspect of a preferred rail joint bar of the present disclosure, the rail joint bar defines a plurality of bolt holes.

In yet another aspect of a preferred rail joint bar of the present disclosure, the rail joint bar defines six or eight bolt holes disposed along a longitudinal center line of the rail joint bar.

In another aspect of a preferred rail joint bar of the present disclosure, the two or three outermost bolt holes on each side of the longitudinal center line of the rail joint bar were produced prior to, and the two innermost bolt holes thereon were produced after, the bending of the rail joint bar to produce the concavely curved first outer surface.

Yet another aspect of a preferred embodiment of the present disclosure comprises a method of making a curved rail joint bar having a plurality of bolt holes disposed along a longitudinal center line of the rail joint bar, wherein half of the plurality of bolt holes are equally-spaced on a first half of the rail joint bar and the other half of the plurality of bolt holes are equally-spaced on a second half of the rail joint bar, comprising: providing a blank rail joint bar without bolt holes, wherein the blank rail joint bar has a first side and a second side; wherein the first side has a longitudinal axis and a first outer surface defining a rounded shape conforming to and fitting within a channel of a side of a railroad rail joint, wherein the channel is defined by a web, a head and a foot of the railroad rail joint; and wherein the second side of the blank rail joint bar has a second outer surface that is flat; drilling all but the two innermost of the plurality of bolt holes into the blank rail joint bar; straightening the blank rail joint bar; immobilizing first and second ends of the blank rail joint bar; pushing on a center of the second outer surface to place the blank rail joint bar under load; releasing the load to produce a convex curve along the longitudinal axis of the first outer surface; and drilling the two innermost of the plurality of bolt holes into the blank rail joint bar.

In another aspect of a preferred method of making a curved rail joint bar of the present disclosure, prior to drilling the two innermost of the plurality of bolt holes, the center of the second outer surface is pushed by 0.75" to 0.85" and then released to allow the blank rail joint bar to spring back to where the convex curve of the first outer surface has a radius of curvature of 82' (25 m) along its longitudinal axis.

In another aspect, the preferred method of making a curved rail joint bar of the present disclosure further comprises molding the blank rail joint bar, in a mold having a concave curvature equal to that of the convexly bent rail joint bar, with cloth and adhesive after the drilling of the two innermost of the plurality of bolt holes.

In another aspect of a preferred method of making a curved rail joint bar of the present disclosure, the blank rail joint bar is 36 inches or 48 inches long.

Yet a further aspect of a preferred embodiment of the present disclosure comprises a method of making a curved rail joint bar having a plurality of bolt holes disposed along a longitudinal center line of the rail joint bar, wherein half of the plurality of bolt holes are equally-spaced on a first half of the rail joint bar and the other half of the plurality of bolt holes are equally-spaced on a second half of the rail joint bar, comprising: providing a blank rail joint bar without bolt holes, wherein the blank rail joint bar has a first side and a second side; wherein the first side has a longitudinal axis and a first outer surface defining a rounded shape conforming to and fitting within a channel of a side of a railroad rail joint, wherein the channel is defined by a web, a head and a foot of the railroad rail joint; and wherein the second side of the blank rail joint bar has a second outer surface that is flat; drilling all but the two innermost of the plurality of bolt holes into the blank rail joint bar; straightening the blank rail joint bar; immobilizing first and second ends of the blank rail joint bar; pushing on a center of the first outer surface to place the blank rail joint bar under load; releasing the load to produce a concave curve along the longitudinal axis of the first outer surface; and drilling the two innermost of the plurality of bolt holes into the blank rail joint bar.

In another aspect of a preferred method of making a curved rail joint bar of the present disclosure, prior to drilling the two innermost of the plurality of bolt holes, the center of the first outer surface is pushed 0.84" to 0.94" and then released to allow the blank rail joint bar to spring back to where the concave curve of the first outer surface has a radius of curvature of 82' (25 m) along its longitudinal axis.

In another aspect, the preferred method of making a curved rail joint bar of the present disclosure further comprises molding the blank rail joint bar, in a mold having a convex curvature equal to that of the concavely bent rail joint bar, with cloth and adhesive after the drilling of the two innermost of the plurality of bolt holes.

In another aspect of a preferred method of making a curved rail joint bar of the present disclosure, the blank rail joint bar is 36 inches or 48 inches long.

BRIEF DESCRIPTION OF THE DRAWINGS

The present disclosure is illustrated by way of example and not limitation in the figures of the accompanying drawings, in which.

DETAILED DESCRIPTION OF PREFERRED EMBODIMENTS

The following description, taken in conjunction with the referenced drawings, is presented to enable one of ordinary skill in the art to make and use the disclosure and to incorporate it in the context of particular applications. Various modifications, as well as a variety of uses in different applications, will be readily apparent to those skilled in the art, and the general principles, defined herein, may be applied to a wide range of aspects. The present disclosure is not intended to be limited to the aspects disclosed herein. Instead, it is to be afforded the widest scope consistent with the disclosed aspects.

Figure 1:
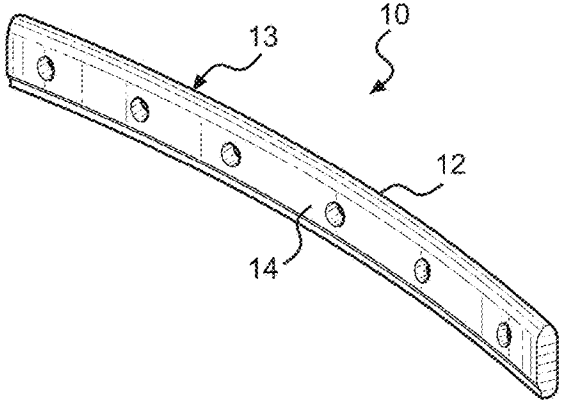
FIG. 1 is a top isometric view of a preferred embodiment of a convexly curved rail joint bar of the present disclosure.
Figure 5:
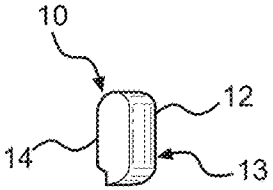
FIG. 5 shows an end view of the convexly curved rail joint bar of FIG. 1.
Figure 2:
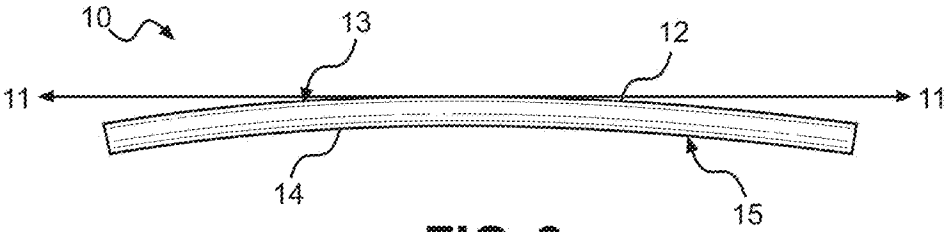
FIG. 2 is a to plan view of the convexly curved rail joint bar of FIG. 1.
Figure 3:
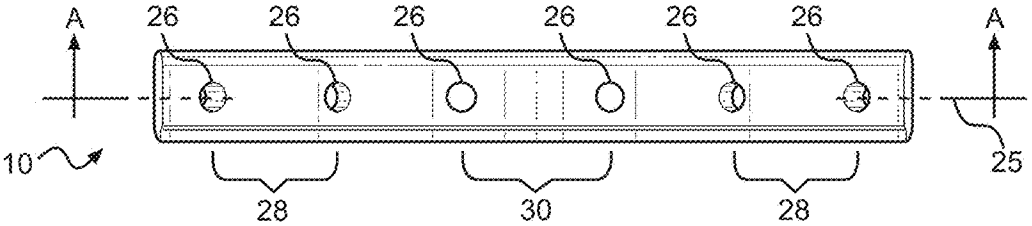
FIG. 3 is a side elevation view of the convexly curved rail joint bar of FIG. 1.
Figure 4:
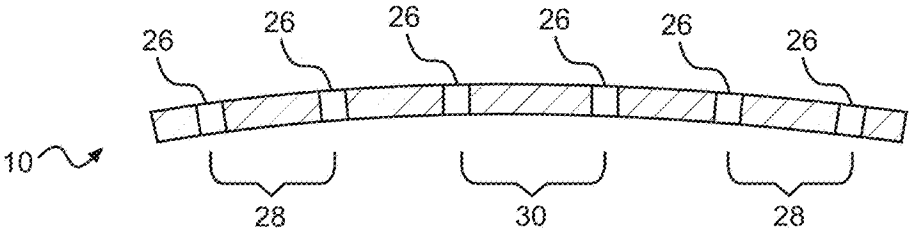
FIG. 4 is a cross-section view of the convexly curved rail joint bar along line A-A of FIG. 3.
Figure 6:
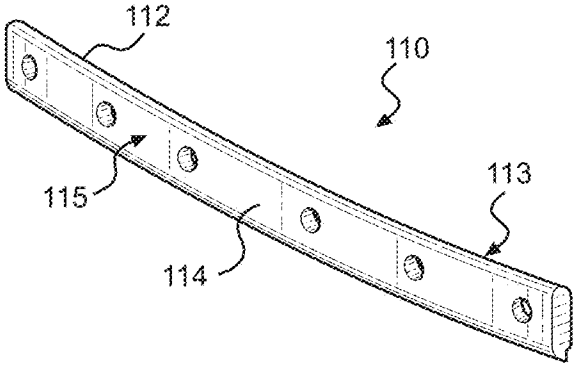
FIG. 6 is a top isometric view of a preferred embodiment of a concavely curved rail joint bar of the present disclosure.
Figure 10:
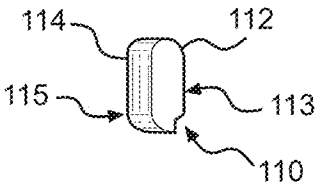
FIG. 10 shows an end view of the concavely curved rail joint bar of FIG. 6.
Figure 7:
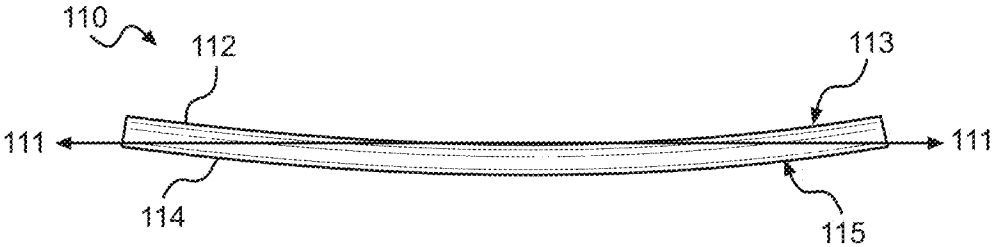
FIG. 7 is a to plan view of the concavely curved rail joint bar of FIG. 6.
Figure 8:
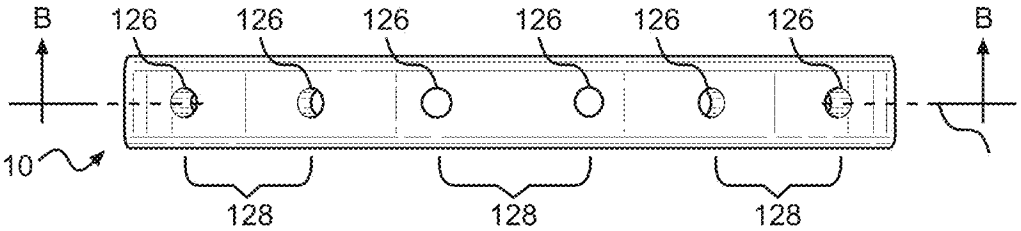
FIG. 8 is a side elevation view of the concavely curved rail joint bar of FIG. 6.
Figure 9:
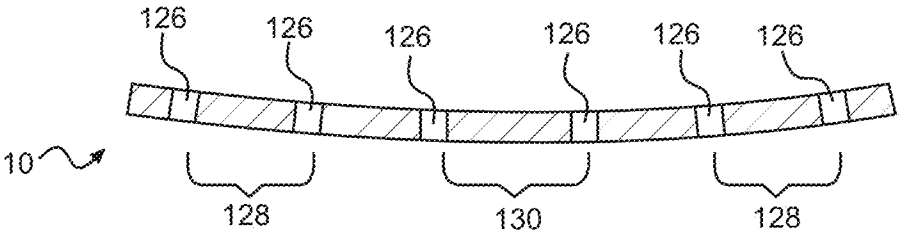
FIG. 9 is a cross-section view of the concavely curved rail joint bar along line B-B of FIG. 8.

FIGS. 1-5 and 11 illustrate a first preferred embodiment of a rail joint bar 10 having a first side 12 and a second side 14. Preferably, first side 12 has a longitudinal axis 11 and a first outer surface 13 curved convexly along the longitudinal axis 11. As shown in FIGS. 5 and 10, preferably, first outer surface 13 defines a rounded shape conforming to and fitting within a concavely curved channel 40 of a side of a curved railroad rail joint 50, wherein the concavely curved channel 40 is defined by a web 52, a head 54 and a foot 56 of the railroad rail joint 50. Preferably second side 14 of rail joint bar 10 has a second outer surface 15 that has a flat surface following the same curvature of the first outer surface 13.

FIGS. 6-10 and 11 illustrate another preferred embodiment of a rail joint bar 110 having a first side 112 and a second side 114. Preferably, first side 112 has a longitudinal axis 111 and a first outer surface 113 curved concavely along the longitudinal axis 111. Preferably, first outer surface 113 defines a rounded shape conforming to and fitting within a convexly curved channel 41 of a side of a curved railroad rail joint 50, wherein the convexly curved channel 41 is defined by a web 52, a head 54 and a foot 56 of the railroad rail joint 50. Preferably second side 114 of rail joint bar 110 has a second outer surface 115 that has a flat surface following the same curvature of the first outer surface 113.

In either embodiment, preferably, first outer surface 13 or 113 of rail joint bar 10 or 110 has a radius of curvature of about 75 to 85 feet. Rail joint bar 10 defines a plurality of bolt holes 26. Preferably, rail joint bar 10 defines 6 or 8 bolt holes 26 disposed along a longitudinal center line 25 of the rail joint bar 10. Also, rail joint bar 110 defines a plurality of bolt holes 226. Preferably, rail joint bar 110 defines 6 or 8 bolt holes 126 disposed along a longitudinal center line 125 of the rail joint bar 110.

Preferably, the two outermost bolt holes 28 or 128 on each side of the longitudinal center line 25 or 125 of the rail joint bar 10 or 110, respectively, with 6 bolt holes 26 or 126 were produced prior to, and the two innermost bolt holes 30 or 130 thereon were produced after, the bending of the rail joint bar 10 or 110 to produce the convexly curved first outer surface 13 or the concavely curved first outer surface 113, respectively. Preferably, the three outermost bolt holes on each side of the longitudinal center line 25 or 125 of the rail joint bar 10 or 110 with 8 bolt holes 26 or 126 were produced prior to, and the two innermost bolt holes 30 or 130 thereon were produced after, the bending of the rail joint bar 10 or 110 to produce the convexly curved first outer surface 13 or the concavely curved first outer surface 113, respectively.

Figure 11:
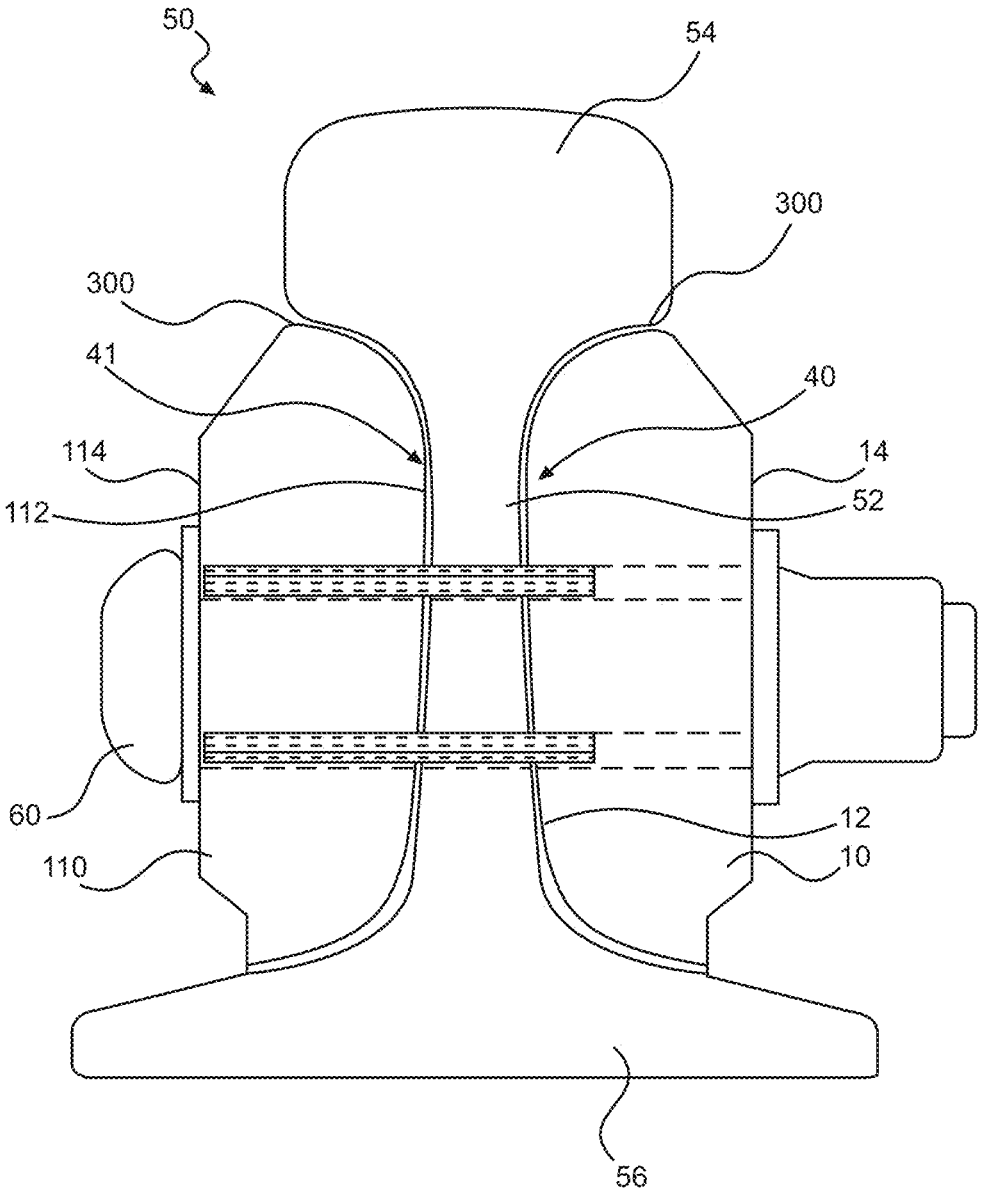
FIG. 11 is a cross-sectional view of the convexly curved and concavely curved rail joint bars of FIGS. 1 and 6, respectively, installed as part of a curved rail joint according to the present disclosure.

FIG. 11 shows convexly curved rail joint bar 10 and concavely curved rail joint bar 110 installed as part of a preferred curved insulated rail joint 50 of the present disclosure.

Figure 12:
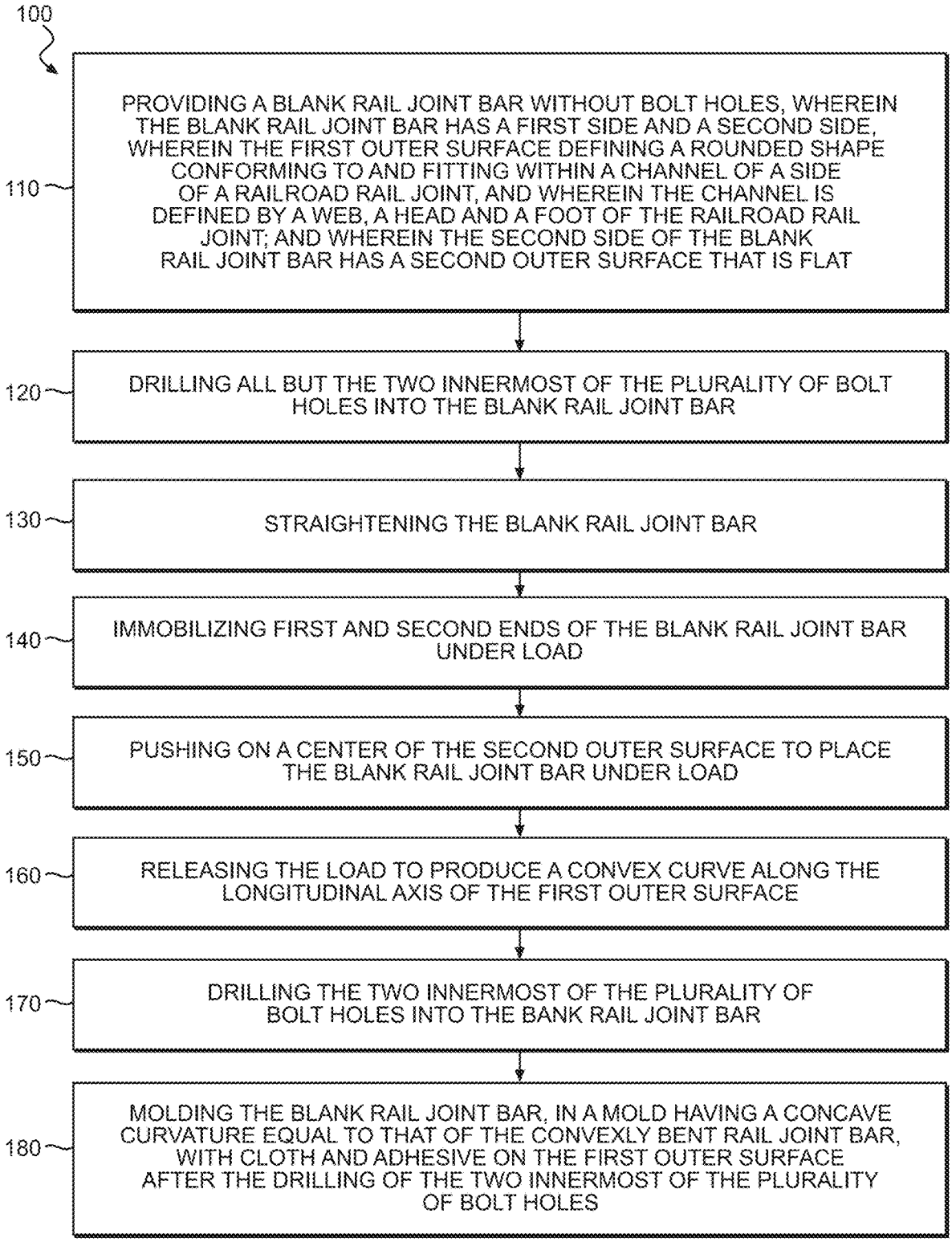
FIG. 12 is a schematic flow chart showing the steps of a preferred method of the present disclosure for making a convexly curved rail joint bar.

The present disclosure is also directed to, as shown in FIG. 12, a preferred method 100 of making a curved rail joint bar having a plurality of bolt holes disposed along a longitudinal center line of the rail joint bar, wherein half of the plurality of bolt holes are equally-spaced on a first half of the rail joint bar and the other half of the plurality of bolt holes are equally-spaced on a second half of the rail joint bar.

Method 100 preferably comprises the following steps:

providing a blank rail joint bar without bolt holes, wherein the blank rail joint bar has a first side and a second side; wherein the first side has a longitudinal axis and a first outer surface defining a rounded shape conforming to and fitting within a channel of a side of a railroad rail joint, wherein the channel is defined by a web, a head and a foot of the railroad rail joint; and wherein the second side of the blank rail joint bar has a second outer surface that is flat as shown at 110 in FIG. 12;

drilling all but the two innermost of the plurality of bolt holes into the blank rail joint bar as shown at 120 in FIG. 12;

straightening the blank rail joint bar as shown at 130 in FIG. 12;

immobilizing first and second ends of the blank rail joint bar as shown at 140 in FIG. 12;

pushing on a center of the second outer surface to place the blank rail joint bar under load as shown at 150 in FIG. 12;

releasing the load to produce a convex curve along the longitudinal axis of the first outer surface as shown at 160 in FIG. 12; and drilling the two innermost of the plurality of bolt holes into the blank rail joint bar as shown at 170 in FIG. 12.

Preferably, in method 100, prior to drilling the two innermost of the plurality of bolt holes at 170 in FIG. 12, the center of the second outer surface is pushed by 0.75" to 0.85" at 150 in FIG. 12 and then released at 160 in FIG. 12 to allow the blank rail joint bar to spring back to where the convex curve of the first outer surface has a radius of curvature of 82' (25 m) along its longitudinal axis.

Method 100 preferably further comprises molding the blank rail joint bar, in a mold having a concave curvature equal to that of the convexly bent rail joint bar, with cloth insulation/epoxy adhesive 300 on the first outer surface after the drilling of the two innermost of the plurality of bolt holes as shown at 180 in FIG. 12.

Preferably in method 100 the blank rail joint bar is 36 inches or 48 inches long.

Figure 13:
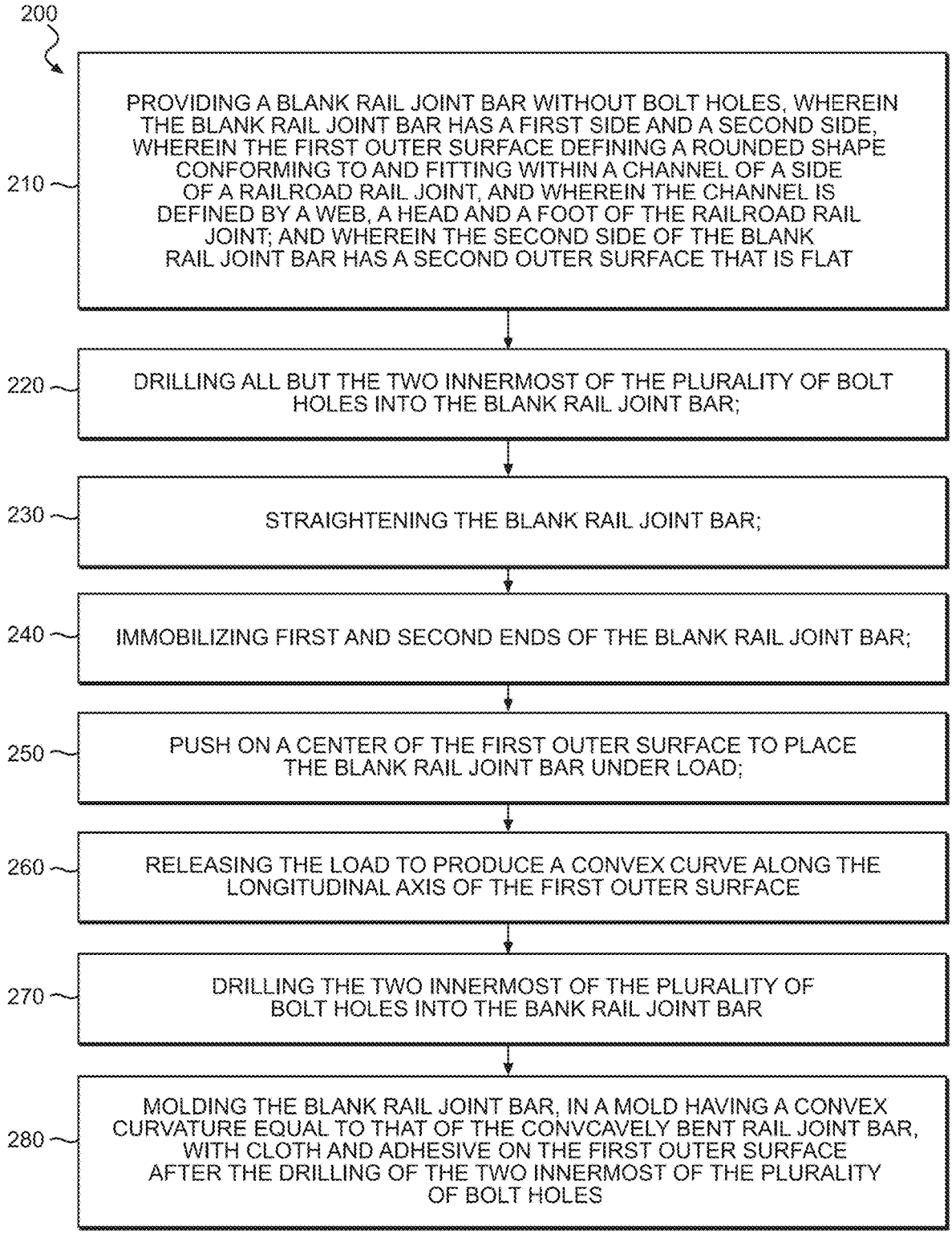
FIG. 13 is a schematic flow chart showing the steps of a preferred method of the present disclosure for making a concavely curved rail joint bar.

The present disclosure is further directed to, as shown in FIG. 13, a preferred method 200 of making a curved rail joint bar having a plurality of bolt holes disposed along a longitudinal center line of the rail joint bar, wherein half of the plurality of bolt holes are equally-spaced on a first half of the rail joint bar and the other half of the plurality of bolt holes are equally-spaced on a second half of the rail joint bar.

Method 200 preferably comprises the following steps:

providing a blank rail joint bar without bolt holes, wherein the blank rail joint bar has a first side and a second side; wherein the first side has a longitudinal axis and a first outer surface defining a rounded shape conforming to and fitting within a channel of a side of a railroad rail joint, wherein the channel is defined by a web, a head and a foot of the railroad rail joint; and wherein the second side of the blank rail joint bar has a second outer surface that is flat as shown at 210 in FIG. 13;

drilling all but the two innermost of the plurality of bolt holes into the blank rail joint bar as shown at 220 in FIG. 13;

straightening the blank rail joint bar as shown at 230 in FIG. 13;

immobilizing first and second ends of the blank rail joint bar as shown at 240 in FIG. 13;

pushing on a center of the first outer surface to place the blank rail joint bar under load as shown at 250 in FIG. 13;

releasing the load to produce a concave curve along the longitudinal axis of the first outer surface as shown at 260 in FIG. 13; and drilling the two innermost of the plurality of bolt holes into the blank rail joint bar as shown at 270 in FIG. 13.

Preferably, in method 200, prior to drilling the two innermost of the plurality of bolt holes at 270 in FIG. 13, the center of the first outer surface is pushed by 0.84" to 0.94" at 250 in FIG. 13 and then released at 260 in FIG. 13 to allow the blank rail joint bar to spring back to where the concave curve of the first outer surface has a radius of curvature of 82' (25 m) along its longitudinal axis.

Method 200 preferably further comprises molding the blank rail joint bar, in a mold having a convex curvature equal to that of the concavely bent rail joint bar, with cloth insulation/epoxy adhesive 300 on the first outer surface after the drilling of the two innermost of the plurality of bolt holes as shown at 280 in FIG. 13.

Preferably in method 200 the blank rail joint bar is 36 inches or 48 inches long.

It should be understood that while the present disclosure has been described herein in terms of specific embodiments set forth in detail, such embodiments are presented by way of illustration of the general principles of the present disclosure, and the present disclosure is not necessarily limited thereto. Certain modifications and variations in any given material, process step or chemical formula will be readily apparent to those skilled in the art without departing from the true spirit and scope of the present disclosure, and all such modifications and variations should be considered within the scope of the claims that follow.

What is claimed is:

1. A rail joint bar, comprising:

a first side and a second side;

wherein the first side has a longitudinal axis and outer surface curved convexly along the longitudinal axis and wherein the first outer surface define a rounded shape conforming to and fitting within a concavely curved channel of a side of a curved railroad rail joint, wherein the concavely curved channel is defined by a web, a head and a foot of the railroad rail joint; and wherein the second side has a second outer surface having approximately the same radius of curvature as the first side.

2. The rail joint bar of claim 1, wherein the first outer surface has a radius of curvature of 82' (25 m) feet.

3. The rail joint bar of claim 1, wherein the first outer surface has a radius of curvature of 75 to 85 feet.

4. The rail joint bar of claim 3, wherein the rail joint bar defines a plurality of bolt holes.

5. The rail joint bar of claim 3, wherein the rail joint bar defines six or eight bolt holes disposed along a longitudinal center line of the rail joint bar.

6. The rail joint bar of claim 5, wherein the two or three outermost bolt holes on each side of the longitudinal center line of the rail joint bar were produced prior to, and the two innermost bolt holes thereon were produced after, the bending of the rail joint bar to produce the convexly curved first outer surface.

7. A rail joint bar, comprising:

a first side and a second side; wherein the first side has a longitudinal axis and a first outer surface curved concavely along the longitudinal axis and wherein the first outer surface defines a shape conforming to and fitting within a convexly curved channel of a side of a curved railroad rail joint, wherein the convexly curved channel is defined by a web; a head and a foot of the railroad rail joint;

wherein the second side has a second outer surface having approximately the same radius of curvature as the first side.

8. The rail joint bar of claim 7, wherein the first outer surface has a radius of curvature of 82' (23 m) feet.

9. The rail joint bar of claim 7, wherein the first outer surface has a radius of curvature of 75 to 85 feet.

10. The rail joint bar of claim 9, wherein the rail joint bar defines a plurality of bolt holes.

11. The rail joint bar of claim 9, wherein the rail joint bar defines six or eight bolt holes disposed along a longitudinal center line of the rail joint bar.

12. The rail joint bar of claim 11, wherein the two or three outermost bolt holes on each side of the longitudinal center line of the rail joint bar were produced prior to, and the two innermost bolt holes thereon were produced after, the bending of the rail joint bar to produce the concavely curved first outer surface.

13. A method of making a curved rail joint bar having a plurality of bolt holes disposed along a longitudinal center line of the rail joint bar, wherein half of the plurality of bolt holes are equally-spaced on a first half of the rail joint bar and the other half of the plurality of bolt holes are equally-spaced on a second half of the rail joint bar, comprising:

providing a blank rail joint bar without bolt holes, wherein the blank rail joint bar has a first side and a second side; wherein the first side has a longitudinal axis and a first outer surface defining a rounded shape conforming to and fitting within a channel of a side of a railroad rail joint, wherein the channel is defined by a web, a head and a foot of the railroad rail joint; and wherein the second side of the blank rail joint bar has a second outer surface that is flat; drilling all but the two innermost of the plurality of bolt holes into the blank rail joint bar;

straightening the blank rail joint bar;

immobilizing first and second ends of the blank rail joint bar;

pushing on a center of the second outer surface to place the blank rail joint bar under load;

releasing the load to produce a convex curve along the longitudinal axis of the first Outer surface;

and drilling the two innermost of the plurality of bolt holes into the blank rail joint bar.

14. The method of making a curved rail joint bar of claim 13 wherein, prior to drilling the two innermost of the plurality of bolt holes, the center of the second outer surface is pushed by 0.75" to 0.85" and then released to allow the blank rail joint bar to spring back to where the convex curve of the first outer surface has a radius of curvature of 82' (25 m) along its longitudinal axis.

15. The method of making a curved rail joint bar of claim 14, further comprising:

molding the blank rail joint bar, in a mold having a concave curvature equal to that of the convexly bent rail joint bar, with cloth and adhesive after the drilling of the two innermost of the plurality of bolt holes.

16. The method of making a curved rail joint bar of claim 13, wherein the blank rail joint bar is 36 inches or 48 inches long.

17. A method of making a curved rail joint bar having a plurality of bolt holes disposed along a longitudinal center line of the rail joint bar, wherein half of the plurality of bolt holes are equally-spaced on a first half of the rail joint bar and the other half of the plurality of bolt holes are equally-spaced on a second half of the rail joint bar, comprising:

providing a blank rail joint bar without bolt holes, wherein the blank rail joint bar has a first side and a second side, wherein the first side has a longitudinal axis and a first outer surface defining a rounded shape conforming to and fitting within a channel of a side of a railroad rail joint, wherein the channel is defined by a web, a head and a foot of the railroad rail joint; and wherein the second side of the blank rail joint bar has a second outer surface that is flat; drilling all but the two innermost of the plurality of bolt holes into the blank rail joint bar;

straightening the blank rail joint bar;

immobilizing first and second ends of the blank rail joint bar;

pushing on a center of the first outer surface to place the blank rail joint bar under load;

releasing the load to produce a concave curve along the longitudinal axis of the first outer surface; and drilling the two innermost of the plurality of bolt holes into the blank rail joint bar.

18. The method of making a curved rail joint bar of claim 17 wherein, prior to drilling the two innermost of the plurality of bolt holes, the center of the first outer surface is pushed 0.84" to 0.94" and then released to allow the blank rail joint bar to spring back to where the concave curve of the first outer surface has a radius of curvature of 82' (25 m) along its longitudinal axis.

19. The method of making a curved rail joint bar of claim 18, further comprising:

molding the blank rail joint bar, in a mold having a convex curvature equal to that of the concavely bent rail joint bar, with cloth and adhesive after the drilling of the two innermost of the plurality of bolt holes.

20. The method of making a curved rail joint bar of claim 17, wherein the blank rail joint bar is 36 inches of 48 inches long.

* * * * *